US007481844B2

(12) United States Patent
Liu et al.

(10) Patent No.: US 7,481,844 B2
(45) Date of Patent: Jan. 27, 2009

(54) JUTE DEGUMMING PROCESS

(75) Inventors: Guozhong Liu, Jiangsu (CN); Ximing Zhang, Jiangsu (CN); Zhenhua Zhang, Shanghai (CN)

(73) Assignee: Suzhou Mbary Advanced Natural Fiber Co., Ltd., Jiangsu (CN)

( * ) Notice: Subject to any disclaimer, the term of this patent is extended or adjusted under 35 U.S.C. 154(b) by 70 days.

(21) Appl. No.: 11/632,595

(22) PCT Filed: May 10, 2005

(86) PCT No.: PCT/CN2005/000649

§ 371 (c)(1),
(2), (4) Date: Jan. 17, 2007

(87) PCT Pub. No.: WO2006/032181

PCT Pub. Date: Mar. 30, 2006

(65) Prior Publication Data

US 2007/0192964 A1 Aug. 23, 2007

(30) Foreign Application Priority Data

Sep. 25, 2004 (CN) ..... 2004 1 0064790

(51) Int. Cl.

| | |
|---|---|
| ***D06L 1/22*** | (2006.01) |
| ***D06L 1/14*** | (2006.01) |
| ***D06L 3/16*** | (2006.01) |
| ***D06L 3/10*** | (2006.01) |

(52) U.S. Cl. ..... 8/138; 8/107

(58) Field of Classification Search ..... 8/138, 8/107

See application file for complete search history.

(56) References Cited

U.S. PATENT DOCUMENTS

| | | | | | |
|---|---|---|---|---|---|
| 4,481,355 | A | * | 11/1984 | Jaskowski | 536/2 |
| 4,568,739 | A | * | 2/1986 | Jaskowski | 536/2 |
| 4,617,383 | A | * | 10/1986 | Jaskowski | 536/2 |
| 6,322,596 | B1 | | 11/2001 | Kish et al. | |

FOREIGN PATENT DOCUMENTS

| | | | |
|---|---|---|---|
| CN | 1048409 | A | 9/1991 |
| CN | 1209833 | | 3/1999 |
| CN | 1047415 | C * | 12/1999 |
| CN | 1266914 | | 9/2000 |

OTHER PUBLICATIONS

Zhang et al., "Studies on Enzymatic Scouring of Linen Rove and Fabric," *Textile Dyeing and Finishing Journal*, 24(2):12-16 (2002).

* cited by examiner

*Primary Examiner*—Lorna M. Douyon
*Assistant Examiner*—Amina Khan
(74) *Attorney, Agent, or Firm*—Patterson, Thuente, Skaar & Christensen, P.A.

(57) ABSTRACT

A process for degumming jute, which includes the following steps: (1) unpacking and bunching of raw jute (2); treating the raw jute with a compound enzyme, which comprises adding to a container an aqueous solution of the compound enzyme made from pectase and laccase so that the jute is treated, taking the jute out the container and patching the jute in a predetermined duration, and finally rinsing the raw jute with hot water (3); reduction bleaching, which comprises adding to the container an aqueous solution of reductive bleaching agent and bleaching the jute, and then adding a decolourizer thereto and treating the jute and finally taking the jute out the container after the treatments are carried out (4) beating the resulting jute, and then rinsing, oiling, dehydrating and drying sequentially, thereby obtaining a decolorized and impurity free jute fiber.

9 Claims, No Drawings

JUTE DEGUMMING PROCESS

RELATED APPLICATION

The present application claims priority to Chinese Application No.200410064790.6 filed Sep. 25, 2004 and International PCT Application No. PCT/CN2005/000649 filed May 10, 2005, both of which are herein incorporated by reference in their entirety.

FIELD OF THE INVENTION

This invention relates to the domain of textile technology; more concretely, it relates to a jute degumming process. A jute fiber obtained after such process can be applied to producing garment material.

BACKGROUND OF THE TECHNOLOGY

Garment materials made from jute textiles are favored by people mainly because jute fiber has good moisture absorption, gas permeability, low static behavior and good mold resistance. However, the above jute garment materials are mainly flax, ramie raw material or such garment materials which are manufactured by blending or interweaving those raw materials and other fibers like wool, chemical fiber, silk, terylene and urethane elastic fiber. The manner of making these jute garment materials including decoloring and other processing is generally characterized by long processing times, higher labor requirements and increased consumption of water and other resources.

For example, the process of degumming ramie can include various steps including unpacking, washing, pickling, boiling off, piling up, flapping, whitening, dehydrating, fluffing, oiling, patching up, oil removing, fluffing and drying. Applicant has attempted this process to degum jute, but has found that the removal rate of jute pigment is only 50%; external color of the resulting fiber is brown yellow; the lining obtained by blending or interweaving jute fiber with such external color and cotton mixed spinning, or mucilage glue, or other fibers, cannot obtain ideal grey cloth with brightness through a whitening procedure; it also baffles the dyeing of light colors which results in gloomy colors. Perhaps from some technical aspects, dark dyeing can cover up these results but the removal rate of the jute is poor, so colorama stability of product after dark dyeing is poor too. Therefore, the removal rate of the jute must reach a required degree of no less than 80% for jute to be successfully applied in producing garment materials. In addition, impurities like xylogen in the jute can cause skin urtication. The removal rate of xylogen should reach 70% in general; otherwise, even if the degumming effect is obvious, jute cannot be applied to producing garment materials.

Jute as a garment material inherently has a variety of inherent weaknesses including harsh fasciculus, stiffness, difficult removal of pigment, poor spinnability and potential skin urtication. Traditionally, jute has been used to process packing materials like jute bags. Less common applications for jute has been the production of carpets, rough wallpaper and other artwork like handbags and cushions. In recent years, increasing use of alternative packing materials like chemical fiber and plastic products have caused the jute market to increasingly shrink resulting in mass overstock and low price of jute as jute does not require rigorous soil selectivity, has a short growing period and high yield quantities. In contrast, flax has rigorous soil selectivity and low yield quantity, which results in unceasing price increases resulting in flax textile being unpopular with the common consumer.

Therefore, in China Patent Grant Publication Number CN1047415C, a kind of technique and device for jute or chemical modification of ambary kenaf blended yarn is disclosed, whose processing steps of chemical modification are as follows:

a. Pickle into NaOH solution for 20 to 40 minutes after jute selection, then seethe in sodium stearate solution for 20 to 40 minutes, acid wash it to neuter gender, whiten it by hydrogen peroxide, oil and dry it, punch it through C11 hackle, then cut it through fiber cutting machine, flip it through flip cotton rack, and oil it to keep moisture, finally pack it;

b. Blend the above modified jute or ambary fiber and cotton fiber. The disadvantages of technical scheme of this patent appear as follows: First, the technique does not appear to effectively reach the removal rates of less than 0.5% pectin content and less than 2% xylogen as described as can be proved from resulting light brown products. Second, the removal rate of pigment is only about 60%. Practice proves that through pickling in a NaOH solution and boiling, the removal rate of jute pigment that obstinately existed is bad, and the effect of xylogen removal is not so good.

In addition, an improved method of producing jute textile introduced in China Patent Grant Publication Number CN1047415C using ammonia and nitrogen treatment, mellowing, dehairing and sanforizing. However, this method aims mainly at producing jute textile and does not relate to concrete degumming and edulcoration revelation of any raw jute.

Moreover, in $24^{th}$ volume of Finishing Technology No.2, April 2002, influences including enzyme classes and how dosages of bio-enzymes and treatment time affecting scouring are introduced. The experimental data provided in this literature addresses flax and xylogen content reductions from 7.2% to 5.4%, pectin content reductions from 3.5% to 1.4%. These removal rates are 25% and 60% respectively, which are the best treatment effects mentioned in the literature. However, xylogen and pectin content are still high enough that the cannot meet the production requirements of flax roving such that qualified flax products cannot be produced. As is well known to all, the plasticity and spinnability of fiber is inversely related to xylogen content. Just as it says in CN1047415, only when pectin and xylogen content are less than 0.5% and 2% respectively does the fiber possess spinnability.

Making a general view of this literature, the following disadvantages are noted. First, the maximum activity of recommended compound enzymes has not been given full consideration. It is mainly because the pH value has not changed significantly according to the different enzyme requirements resulting in low removal rate of pectin and xylogen. Second, compound enzymes are used on 1:30 liquor ratio condition that increasingly reduces labor capacity of flax degumming process and causes large waste of water and other resources like electricity and additives so that it has no economical efficiency and industrial production cannot bear it. Third, parallel literature believes "on condition of optimum temperature and similar pH value, there is synergism among compound enzyme (8 to 9 lines, 3.3 column, $_4$th page of literature)". However, applicant's experiments prove that if we adopt similar pH value and choose mesial magnitudes required by compound enzyme, the compound enzyme synergism is tiny. It properly proves that compound enzymes might mutually interfere with each other so as to invalidate the enzyme effects. The experimental data provided in this parallel literature indicates that compound enzyme efficacy has not been given full play. Therefore, the parallel literature has not revealed reasonable pH values in choosing compound enzymes. Fourth, the experimental object of the literature is flax. Xylogen content in flax is less than that in jute (please see Utilization of Jute published in 1993 edited by Gu Mingjin and so on, and Flax Spinning published in 1987 edited by Gu Boming and so on). Therefore, if we use methods recommended in literature to degum jute fiber and remove xylogen, the effects will be worse.

As a result, there are no garment materials blending jute and jute cotton in the market at home and abroad.

SUMMARY OF THE INVENTION

The object of this invention is to provide a kind of jute degumming process that features effective removal of impurities like pigment and xylogen in jute fiber with an easy process and low cost.

The object of the jute degumming process is attained as follows:

(1) Unpacking and bunching of the raw jute;

(2) Treating the raw jute with a compound enzyme, which comprises adding to the container the aqueous solution of the compound enzyme made from pectase and laccase so that the jute is treated. Taking the jute out of the container and patching the jute up for a predetermined duration. Finally, rinsing the raw jute with hot water;

(3) Reduction bleaching of the raw jute, which comprises adding to the container an aqueous solution of reductive bleaching agent and bleaching the jute, followed by adding a decolourizer thereto and treating the jute. Finally, the jute is taken out of the container after the treatments are carried out;

(4) Beating the resulting jute, followed by rinsing, oiling, dehydrating, drying sequentially, thereby the jute fiber is decolorized and impurity free jute fiber is obtained.

In order to give the respective effect of pectase and laccase full play, treating the raw jute with a compound enzyme process contains two steps in an executive plan of this invention. First, raw jute is treated at a condition of pH from 5.0 to 5.5 and a temperature of 55 to 60 degrees centigrade (on such conditions the removal activity of laccase on impurities like xylogen will be given full play). Then the raw jute is treated at a condition of pH from 7.5 to 8.0 and temperature from 60 to 70 degrees centigrade (on such conditions the removal activity of pectase on pectin and impurities that exist with pectin (such as decoloring) will be given full play).

In another executive plan of this invention, the aqueous solution of the compound enzyme comprises compound enzymes of pectase and laccase weighing 1% to 2% of the raw jute and water that weighs 15 times as much as the raw jute.

In another executive plan of this invention, the weight ratio of pectase and laccase in the compound enzyme narrated in step 2 is 3:1.

In another executive plan of this invention, the time for patching the jute up in the predetermined duration narrated in step 2 is 10 to 14 hours.

In another executive plan of this invention, the hot water temperature for rinsing the raw jute narrated in step 2 is 85 to 95 degrees centigrade.

In another executive plan of this invention, the weight of bleaching agent decolourizer narrated in step 3 is 1% to 2% of the raw jute weight respectively.

In another executive plan of this invention, reduction bleaching in step 3 proceeds at a temperature of 85 to 95 degrees centigrade.

In another executive plan of this invention, oiling in step 4 means confecting aminosilicone oil and a polyvinyl emulsion at a 1:1 ratio for a total of 1% of raw jute weight and water that is 10 times the raw jute weight and blending them to dip the raw jute fiber for a dipping time of 30 minutes and at a temperature of 45 degrees centigrade.

The decoloring rate and removal of impurities like xylogen from jute fiber in this invention are above 89% and 76% respectively. The external color of jute obtained from this technique is white. After blending and interweaving the resulting jute with other fibers like cotton and chemical fiber, jute fiber can fully meet the requirements of garment materials. Moreover, the technique involves simple procedures, saves water and other resources, has low cost and high productivity.

DETAILED DESCRIPTION OF THE EMBODIMENT

Embodiment 1

(1) Unpack raw jute from, for example, the Jiangsu Textile Company and divide it into small bunches of about 0.5 kilogram;

(2) Take the compound enzyme made from a 3:1 ratio (weight ratio) of pectase and laccase that weighs 1% of the raw jute and water that weighs 15 times the raw jute, blend them and throw them into the treating tank. Using acetic acid and saleratus, adjust the pH value to between 5.0 and 5.5 and warm to 55 degrees centigrade. Treat the raw jute in the treating tank for 50 minutes.

Under such conditions of temperature and pH value, laccase activity will be given full play so as to remove impurities like xylogen. Using acetic acid, adjust the pH value to 7.5 and 8 and warm to a temperature of 60 degrees centigrade. Continue to treat the raw jute for 50 minutes whereupon under such conditions of temperature and pH value, pectase activity will be given full play so as to remove pectin and impurities that adhibits with pectin. Pile up the jute for 14 hours after taking it out to continue to make use of enzyme. Finally, rinse the jute with hot water at 85 to 95 degrees centigrade. The pectase and laccase narrated above can comprise Bioprep and Denilite produced by Danmark Novozymes Corporation respectively.

(3) Take a reductive bleaching agent that weighs 2% of the raw jute and water that weighs 15 times the raw jute, blend them and throw them into the treating tank. Warm the treating tank to 85 degrees centigrade and hold for 70 minutes. Add the decolourizer that weighs 1% of the raw jute and preserve such heat for 70 minutes and take the raw jute out. The reductive bleaching agent and decolourizer narrated above comprise A-Q type and B-W type distributed by Jiangsu Suzhou Jinfang Trading Co. Ltd. respectively;

(4) Throw the raw jute obtained from step 3 into a stamping machine to stamp it and rinse it. Then confect POWER-18 type aminosilicone oil as sold by Shanghai Agent of German Wacker Corporation and polyvinyl emulsion that sold in market with a 1:1 ratio and in an amount of 1% of raw jute weight and water that is 5 to 10 times the raw jute weight and blend them wherein the raw jute fiber is dipped at a temperature of 45 degrees centigrade for 30 minutes. Finally, the raw jute is dehydrated and dried to obtain a jute fiber product.

Embodiment 2

(1) Unpack raw jute from, for example, the Jiangsu Textile Company and divide it into small bunches of about 0.5 kilogram;

(2) Take the compound enzyme made from a 3:1 ratio (weight ratio) of pectase and laccase that weighs 1.5% of the raw jute and water that weighs 15 times the raw jute, blend them and throw them into treating tank. Using acetic acid and saleratus, adjust the pH value to between 5.0 and 5.5; and warm to 57.5 degree centigrade. Treat the raw jute in the treating tank for 35 minutes. Under such conditions of temperature and pH value, laccase activity will be given full play so as to remove impurities like xylogen. Using acetic acid, adjust the pH value up to between 7.5 and 8 and warm to a temperature of 65 degrees centigrade. Continue to treat the raw jute for 35 minutes whereupon such conditions of temperature and pH value, pectase activity will be given full play so as to remove pectin and impurities that adhibits with pectin. Pile up the jute for 10 hours after taking it out to continue to make use of enzyme. Finally, rinse the jute with hot water at 85 to 95 degree centigrade. The pectase and laccase narrated above can comprise Bioprep and Denilite produced by Danmark Novozymes Corporation respectively.

(3) Take a reductive bleaching agent that weighs 1.5% of the raw jute and water that weighs 15 times the raw jute, blend them and throw them into the treating tank. Warm the treating tank to 88 degrees centigrade and hold for 60 minutes. Add the decolourizer that weighs 1.5% of the raw jute and preserve such heat for 50 minutes and take the raw jute out. The reductive bleaching agent and decolourizer narrated above comprise A-Q type and B-W type distributed by Jiangsu Suzhou Jinfang Trading Co. Ltd. respectively;

(4) Throw the raw jute obtained from step 3 into a stamping machine to stamp it and rinse it. Then confect POWER-18 type aminosilicone oil as sold by Shanghai Agent of German Wacker Corporation and polyvinyl emulsion that sold in market with a 1:1 ratio and in an amount of 1% of raw jute weight and water that is 5 to 10 times the raw jute weight and blend them wherein the raw jute fiber is dipped at a temperature of 45 degrees centigrade for 30 minutes. Finally, the raw jute is dehydrated and dried to obtain a jute fiber product.

Embodiment 3

(1) Unpack raw jute from, for example, the Jiangsu Textile Company and divide it into small bunches of about 0.5 kilograms;

(2) Take the compound enzyme made from a 3:1 ratio (weight ratio) of pectase and laccase that weighs 2% of the raw jute and water that weighs 15 times the raw jute, blend them and throw them into the treating tank. Using acetic acid and saleratus, adjust the pH value to between 5.0 and 5.5 and warm to 60 degrees centigrade. Treat the raw jute in the treating tank for 25 minutes. Under such conditions of temperature and pH value, laccase activity will be given full play so as to remove impurities like xylogen. Using acetic acid, adjust the pH value to between 7.5 and 8.0 and warm to a temperature of 70 degrees centigrade. Continue to treat the raw jute for 25 minutes whereupon such conditions of temperature and pH value, pectase activity will be given full play so as to remove pectin and impurities that adhibits with pectin. Pile up the jute for 12 hours after taking it out to continue to make use of enzyme. Finally, rinse the jute with hot water at 85 to 95 degrees centigrade. The pectase and laccase narrated above can comprise Bioprep and Denilite produced by Danmark Novozymes Corporation respectively.

(3) Take a reductive bleaching agent that weighs 1% of the raw jute and water that weighs 15 times the raw jute, blend them and throw them into the treating tank. Warm the treating tank to 90 degrees centigrade and hold for 50 minutes. Add the decolourizer that weighs 2% of the raw jute and preserve such heat for 30 minutes and take the raw jute out. The reductive bleaching agent and decolourizer narrated above comprise A-Q type and B-W type distributed by Jiangsu Suzhou Jinfang Trading Co. Ltd. respectively;

(4) Throw the raw jute obtained from step 3 into a stamping machine to stamp it and rinse it. Then confect POWER-18 type aminosilicone oil as sold by Shanghai Agent of German Wacker Corporation and polyvinyl emulsion that sold in market with a 1:1 ratio and in an amount of 1% of raw jute weight and water that is 5 to 10 times the raw jute weight and blend them to wherein the raw jute fiber is dipped at a temperature of 45 degrees centigrade for 30 minutes. Finally, the raw jute is dehydrated and dried to obtain a jute fiber product.

Examining the jute fiber product obtained from the above example of the invention, the measured removal rate of pigment and impurities like xylogen as well as the resulting jute fiber color as indiated in the table below all indicate effects that are better than existing technology and, which can meet with application requirements of garment materials.

| Detection content | Traditional craftwork | Finishing technology vol. 24 (2) Apl 2002 treating object is flax | This Invention Embodiment 1 | This Invention Embodiment 2 | This Invention Embodiment 3 |
|---|---|---|---|---|---|
| Pigment removal rate | 50% | | 90% | 89% | 91% |
| Xylogen impurity removal rate | 30% | 25% | 76% | 78% | 77% |
| Color | Brown yellow | | White | White | White |

The invention claimed is:

1. A jute degumming process comprising:

(1) unpacking and bunching of the raw jute;

(2) treating the raw jute with a compound enzyme, which comprises adding to a container an aqueous solution of the compound enzyme made from pectase and laccase so that the jute is treated, taking the jute out of the container and patching the jute up for a predetermined duration, and finally rinsing the raw jute with hot water;

(3) reduction bleaching, which comprises adding to the container an aqueous solution of reductive bleaching agent and bleaching the jute, and then adding a decolourizer thereto and treating the jute, finally taking the jute out of the container after the treatments are carried out;

(4) stamping the resulting jute, and then rinsing, oiling, dehydrating and drying the jute sequentially, whereby the jute fiber is decolorized and an impurity free jute fiber product is obtained.

2. The jute degumming process as in claim 1, wherein, treating the raw jute with a compound enzyme in step 2 contains two steps: first, treating raw jute at a pH of 5.0 to 5.5 and a temperature of 55 to 60 degrees centigrade, followed by subsequent treatment at a pH of 7.5 to 8.0 and a temperature of 60 to 70 degrees centigrade.

3. The jute degumming process as in claim 1, wherein, the aqueous solution of the compound enzyme in step 2 comprises pectase and laccase weighing 1% to 2% of the raw jute and water weighing 15 times the raw jute.

4. The jute degumming process as in claim 3, wherein the weight ratio of pectase and laccase in the aqueous solution of the compound enzyme in step 2 is 3:1.

5. The jute degumming process as in claim 1, wherein, the time for patching the jute up for a predetermined duration in step 2 is 10 to 14 hours.

6. The jute degumming process as in claim 1, wherein the hot water temperature for rinsing the raw jute in step 2 is 85 to 95 degrees centigrade.

7. The jute degumming process as in claim 1, wherein the weight of bleaching agent decolourizer in step 3 is 1% to 2% of the raw jute weight.

8. The jute degumming process as in claim 1, wherein, reduction bleaching in step 3 proceeds at at temperature of 85 to 95 degrees centigrade.

9. The jute degumming process as in claim 1, wherein, the oiling in step 4 means confecting an aminosilicone oil and polyvinyl emulsion at a 1:1 ratio and in an amount of 1% of the raw jute weight and water at 10 times the raw jute weight and blending them and dipping the raw jute fiber with a dipping time of 30 minutes and a temperature of 45 degrees centigrade.

* * * * *